US007414213B2

(12) United States Patent
Hwang et al.

(10) Patent No.: US 7,414,213 B2
(45) Date of Patent: Aug. 19, 2008

(54) MANUFACTURING METHOD OF KEYPAD FOR MOBILE PHONE AND KEYPAD MANUFACTURED THEREBY

(75) Inventors: Yong-Wook Hwang, Suwon-si (KR); Young-Ki Kim, Yongin-si (KR); Shin-Chul Kang, Seoul (KR); Hyun-Jung Jeong, Seongnam-si (KR); Chang-Youn Hwang, Suwon-si (KR); Woo-Seok Chin, Suwon-si (KR); Yoon-Hee Lee, Incheon (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 11/835,999

(22) Filed: Aug. 8, 2007

(65) Prior Publication Data

US 2008/0035460 A1 Feb. 14, 2008

(30) Foreign Application Priority Data

Aug. 8, 2006 (KR) ..... 74834/2006

(51) Int. Cl.
*H01H 3/12* (2006.01)

(52) U.S. Cl. ..... 200/341; 200/314; 341/20; 345/170; 29/622

(58) Field of Classification Search ..... 200/310–314, 200/341–345, 512, 520; 341/20, 21, 31; 345/23–30, 170, 173; 29/622, 832, 835
See application file for complete search history.

(56) References Cited

U.S. PATENT DOCUMENTS 5,471,023 A * 11/1995 Kaizu et al. ..... 200/310
5,664,667 A * 9/1997 Kenmochi ..... 200/314
6,762,381 B2 * 7/2004 Kunthady et al. ..... 200/512
6,977,352 B2 * 12/2005 Oosawa ..... 200/314

FOREIGN PATENT DOCUMENTS

| | | |
|---|---|---|
| JP | 05-083347 | 4/1993 |
| JP | 2001-057125 | 2/2001 |
| JP | 2002-298681 | 10/2002 |
| JP | 2004-006154 | 1/2004 |
| JP | 2005-216833 | 8/2005 |

* cited by examiner

*Primary Examiner*—K. Richard Lee
(74) *Attorney, Agent, or Firm*—The Farrell Law Firm, PC

(57) ABSTRACT

Disclosed is a manufacturing method of a keypad for a mobile phone and the keypad manufactured thereby, in which a vacuum deposition layer and a cellophane paper are attached to a lower surface of a key in the keypad. The keypad for a mobile phone includes a plurality of keys, each key includes a key body of a transparent resin material and a high-hardness transparent coating layer coated onto a surface of the key body in order to increase hardness, and each key comprises a key background color paint layer for color presentation, coated onto a lower surface of the key body; an opaque paint layer coated onto a lower surface of the key background color paint layer; a transparent marking portion formed by performing a laser processing according to a shape of a numeral, a character, or a symbol with respect to the lower surface of the key body so as to remove the color paint layer and the opaque paint layer; a metallic vacuum deposition layer formed on the lower surface of the key body and a lower surface of the opaque paint layer; and a transparent color-printed layer or a cellophane paper attached to a lower surface of the metallic vacuum deposition layer so as to present various colors.

18 Claims, 6 Drawing Sheets

MANUFACTURING METHOD OF KEYPAD FOR MOBILE PHONE AND KEYPAD MANUFACTURED THEREBY

PRIORITY

This application claims the benefit under 35 U.S.C. 119(a) of an application entitled "Manufacturing Method Of Keypad For Mobile Phone And Keypad Manufactured Thereby" filed in the Korean Intellectual Property Office on Aug. 8, 2006 and assigned Serial No. 2006-74834, the contents of which are incorporated herein by reference.

BACKGROUND OF THE INVENTION

1. Field of the Invention

The present invention relates to a manufacturing method of a keypad for a mobile phone and the keypad manufactured thereby, and more particularly to a method for manufacturing a keypad which can provide a transparent or translucent marking portion (such as a number, a character, or a symbol of the key) with an elegant metallic glossy image, and present various color images when light is emitted, by attaching a vacuum deposition layer and a cellophane paper to a lower surface of a key in the keypad of the mobile phone.

2. Description of the Related Art

In general, "portable communication devices" refers to devices that are portable and enable the users of the devices to perform wireless communications. Portable communication devices include an HHP (hand-held phone), a CT-2 (cordless telephone 2) cellular phone, a digital phone, a PCS (personal communication system) phone, and a PDA (personal digital assistant), and are classified into various types according to their external appearance. For example, mobile phones are classified into bar-type, flip-type, folder-type, and slide-type mobile phones according to their external appearance. The above-mentioned conventional mobile phones necessarily include an antenna unit, a data input/output unit, and a data transceiver. A keypad for enabling the user to input data through a pressing operation using his/her fingers is generally used as the data input unit, and includes a plurality of keys arranged thereon.

The structure of a mobile phone including a keypad 1 will now be described with reference to FIG. 1. A plurality of keys 4, each of which includes a transparent or translucent marking portion 3 for displaying a number, a character, or a symbol, are constructed on an elastic pad 2 so that the user may easily identify operational functions and touch a key to input a desired operational signal.

The key 4 secures a desired color and durability through the spraying, coating, and printing processes performed with respect to the upper surface of the key body 5 (see FIG. 3) of a transparent or translucent resin material (see FIG. 2). In addition, in order to increase marking resolution of numerals, characters, and symbols, a laser etching process is performed adaptively to the transparent or translucent marking portion 3, so that light generated by a light emitting unit 11 installed on a printed circuit board 10 can be easily transmitted through the transparent or translucent marking portion 3, thereby remarkably displaying the transparent or translucent marking portion 3.

The manufacturing method of the key 4 will now be described with reference to FIGS. 2 and 3.

First, a color paint for forming a transparent or translucent marking background color paint layer 6 for the transparent or translucent marking portion 3 is coated onto the key body 5 made of a transparent or translucent resin material, and then an opaque paint layer 7 is coated so as to prevent light from being transmitted through portions other than the transparent or translucent marking portion 3.

For the opaque paint layer 7, a black paint is generally used in consideration of a light absorbing characteristic and a laser workability characteristic. If a key background has a color of the black series or gray series, it is possible to omit the process of coating the opaque paint layer 7. Thereafter, a second color key background paint layer 8 for presentation of a key background color is coated. Then, in order to form the transparent or translucent marking portion 3, a laser etching process is performed adaptively to the shape of a numeral, a character, or a symbol, so that the second color paint layer 8 for a key background color and the opaque paint layer 7 may be removed, and only the first marking color paint layer 6 for forming the transparent or translucent marking portion will remain at the corresponding laser-etched portion, thereby enabling light, which has been generated by the light emitting unit 11 installed on the printed circuit board 10, to be transmitted through the corresponding portion. Finally, a high-hardness transparent coating layer 9 is coated onto the surface of the key 4 so as to secure hardness of the surface and improve abrasion resistance thereof.

Meanwhile, the construction of the coating layers 7 and 8 varies depending on the key background color. That is, when the key background color is a light color such as white, generally a silver paint layer (not shown) is formed between the opaque paint layer 7 and the key background color paint layer 8 so as to prevent the light background color from being dark due to the opaque paint layer 7 of a black color.

However, although a high-hardness transparent or translucent coating layer is formed as the last layer for a key in order to secure hardness of the key surface in the prior art, an abrasion phenomenon happens due to the use of the key after a predetermined period has passed, so that the high-hardness transparent coating layer, the key background color paint layer, and a transparent or translucent marking portion, which have been formed on the upper portion of the key, wear away.

In addition, according to the conventional key manufacturing method, since a color is presented by a method of spraying/coating each of the paint layers on the upper surface of the key, it is impossible to present an elegant metallic gloss. Also, according to the conventional key manufacturing method, since the transparent or translucent marking portion is constructed with only one color paint layer, such as green, red, white, etc., it is impossible to present various colors and effects when the keypad emits light.

SUMMARY OF THE INVENTION

Accordingly, the present invention has been made to solve the above-mentioned problems occurring in the prior art, and an object of the present invention is to provide a manufacturing method of a keypad for a mobile phone and the keypad manufactured thereby, which can provide a transparent or translucent (hereinafter "light-transmissive") marking portion (such as a number, a character, or a symbol of the key) with an elegant metallic glossy image, and present various color images when light is emitted, by attaching a vacuum deposition layer and a cellophane paper to a lower surface of a key in the keypad of the mobile phone.

Another object of the present invention is to provide a manufacturing method of a keypad for a mobile phone and the keypad manufactured thereby, in which a key body is formed of a high-hardness transparent resin material, thereby improving the abrasion resistance and scratch resistance of the key.

To accomplish these objects, in accordance with one aspect of the present invention, there is provided a keypad for a mobile phone including a plurality of keys, each of which includes a key body of a light-transmissive resin material and a high-hardness transparent coating layer coated onto a surface of the key body in order to increase hardness, the key pad including a key background color paint layer for color presentation, coated onto a lower surface of the key body; an opaque paint layer coated onto a lower surface of the key background color paint layer; a light-transmissive marking portion formed by performing a laser processing according to a shape of a numeral, a character, or a symbol with respect to a lower surface of the key body so as to remove the key background color paint layer and the opaque paint layer; a metallic vacuum deposition layer formed on a lower surface of the key background color paint layer and the opaque paint layer; and a color-printed layer or cellophane paper attached to a lower surface of the metallic vacuum deposition layer so as to present various colors.

In accordance with another aspect of the present invention, there is provided a method for manufacturing a keypad which includes a plurality of keys, the method including forming a key body of a light-transmissive resin material; coating a high-hardness transparent coating layer onto a surface of the key body in order to increase hardness; coating a key background color paint layer for color presentation onto a lower surface of the key body; coating an opaque paint layer onto a lower surface of the key background color paint layer in order to prevent light from being transmitted through a portion other than a light-transmissive marking portion; forming the light-transmissive marking portion by performing a laser processing according to a shape of a numeral, a character, or a symbol with respect to a lower surface of the key body so as to remove the key background color paint layer and the opaque paint layer; forming a metallic vacuum deposition layer on a lower surface of the color paint layer and the opaque paint layer; and attaching a color-printed layer or cellophane paper to a lower surface of the metallic vacuum deposition layer so as to present various colors.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENT

Hereinafter, a preferred embodiment of the present invention will be described in detail with reference to the accompanying drawings.

Figure 1:
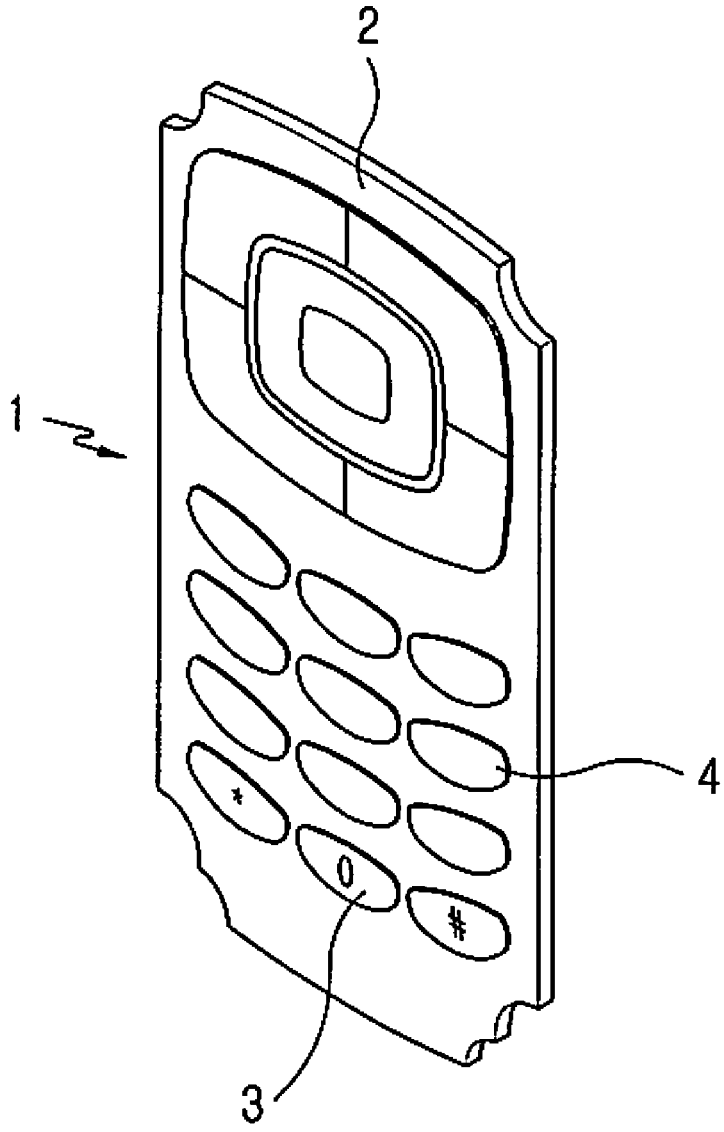
FIG. 1 (PRIOR ART)
FIG. 1 is a perspective view illustrating a conventional keypad for a mobile phone.
Figure 2:
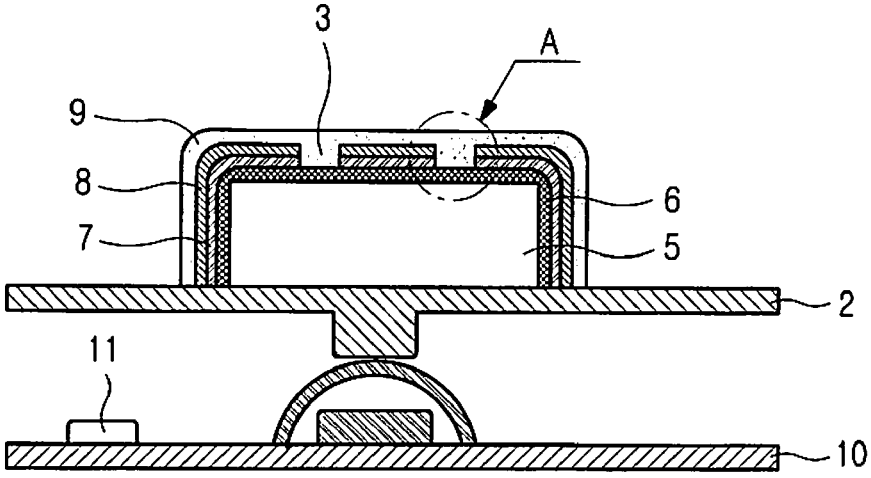
FIG.2 (PRIOR ART)
FIG. 2 is a side sectional view of the keypad shown in FIG. 1.
Figure 3:
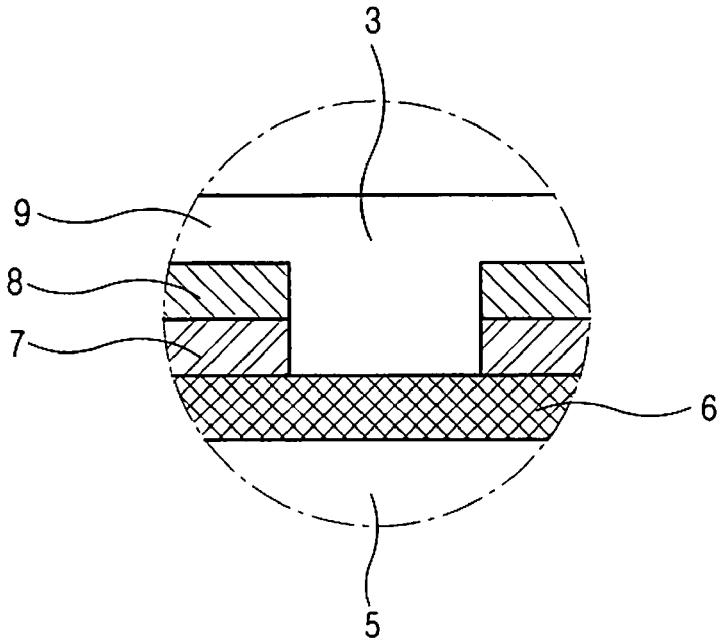
FIG.3 (PRIOR ART)
FIG. 3 is an enlarged view of a region of "A" shown in FIG. 2.
Figure 4:
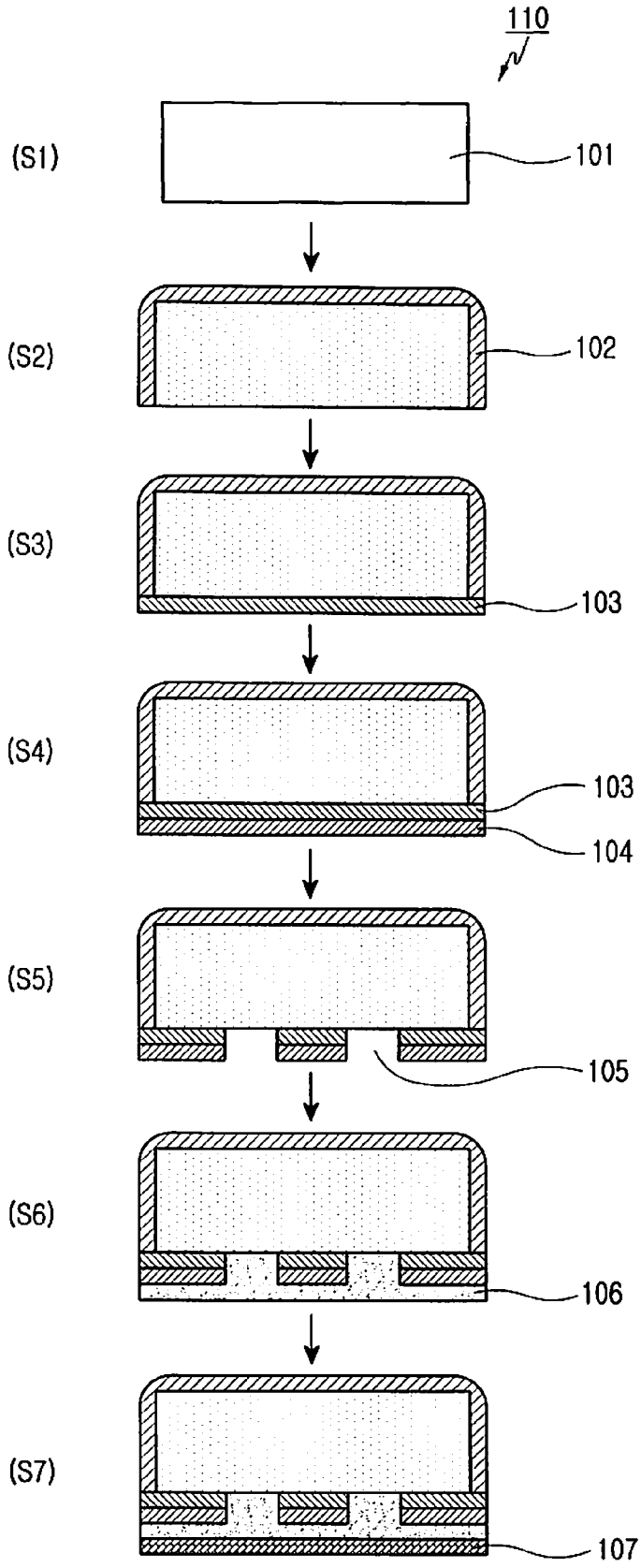
FIG. 4 is an exploded perspective view illustrating the construction of a keypad for a mobile phone according to the present invention.
Figure 7:
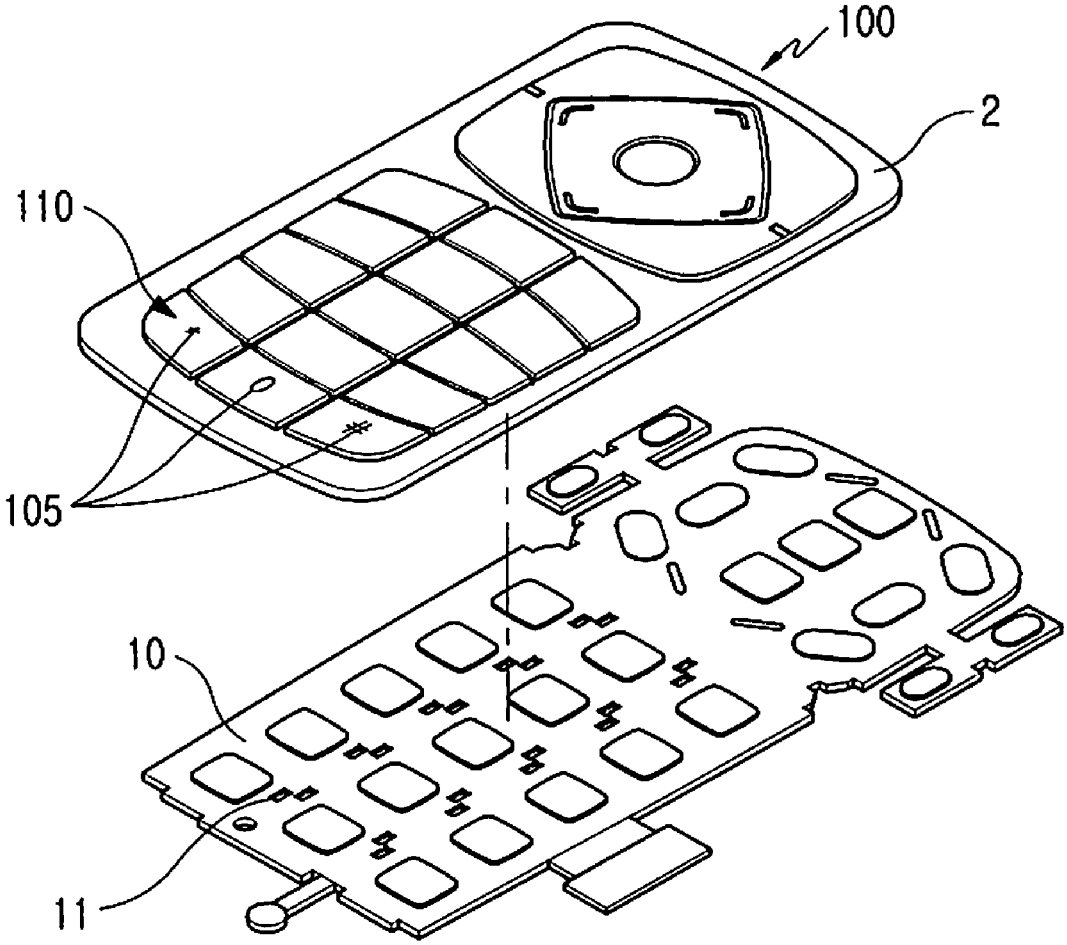
FIG. 7 is an exploded perspective view illustrating a use state of the keypad for the mobile phone according to the present invention.

As shown in FIG. 7, a keypad 100 of a mobile phone includes a plurality of keys 110. As shown in FIG. 4, a key body 101 of the key 110 is formed of a light-transmissive resin material, and a high-hardness transparent coating layer 102 is coated onto the surface of the key body 101 in order to increase hardness.

The light-transmissive resin material includes polycarbonate, acrylic resin, and polyethylene terephthalate (PET). In addition, the light-transmissive resin material may include additives for reinforcing hardness and a lubrication property so as to improve the abrasion resistance and scratch resistance properties of the key body 101.

Herein, if the key body 101 is formed of the light-transmissive resin material including the hardness-reinforcement and lubrication-property-reinforcement additives, a process of coating the high-hardness transparent coating layer 102 onto the surface of the key body 101 is omitted.

Figure 5:
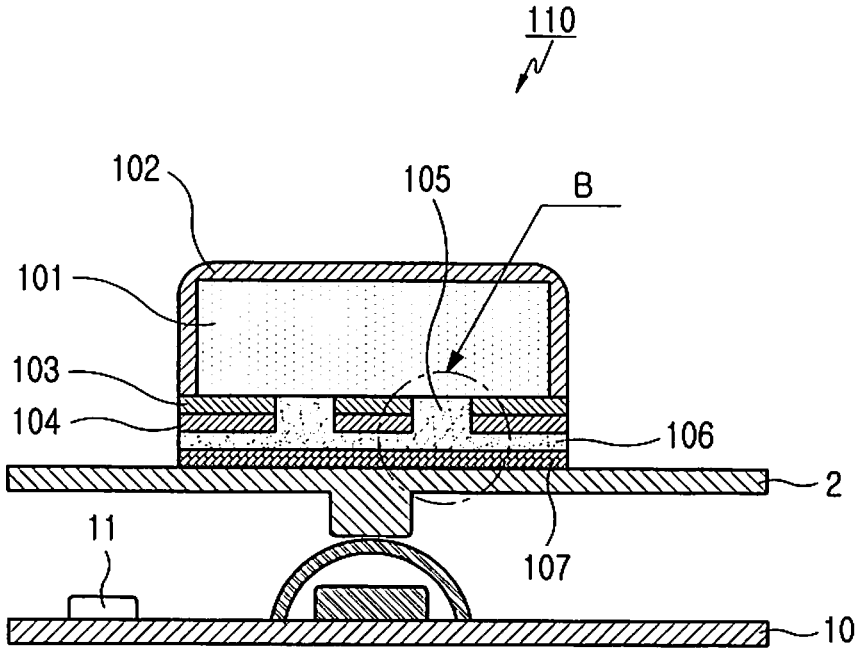
FIG. 5 is a side sectional view of the keypad for the mobile phone according to the present invention.

Next, as shown in FIGS. 4 and 5, a key background color paint layer 103 for color presentation is coated onto a lower surface of the key body 101, and then a light-shielding or opaque paint layer 104 is coated onto a lower surface of the color paint layer 103 in order to prevent light from being transmitted through a portion other than a light-transmissive marking portion described later. When the key background color paint layer 103 and opaque paint layer 104 have been sequentially coated onto the lower surface of the key body 101, a laser processing according to the shape of a numeral, a character, or a symbol is performed with respect to the lower surface of the key body 101 so as to remove a part of the color paint layer 103 and opaque paint layer 104, thereby forming the light-transmissive marking portion 105. Next, a metallic vacuum deposition layer 106 is formed on a lower surface of the color paint layer 103 and opaque paint layer 104 so as to provide an elegant metallic gloss to the keypad 100.

The metallic vacuum deposition layer 106 may be made from aluminum (Al), chromium (Cr), Nickel (Ni), tin (Sn), and titanium (Ti), and may be a compound layer which is made from silicon dioxide ($SiO_2$), titanium dioxide ($TiO_2$), or zirconium dioxide ($ZrO_2$) depending on the end use purpose.

Figure 6:
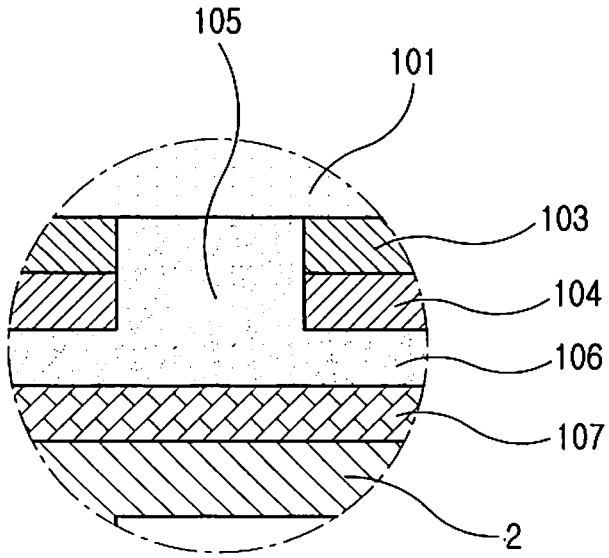
FIG. 6 is an enlarged view of a region of "B" shown in FIG. 5.

As shown in FIG. 6, a color-printed layer or cellophane paper 107 is attached to a lower surface of the metallic vacuum deposition layer 106 so as to present various colors through the light-transmissive marking portion 105 when the key emits light.

The attachment of the cellophane paper 107 may be achieved by using transparent adhesives (not shown) or by a heat treatment process for applying heat.

As shown in FIGS. 5, 6, and 7, the key body 101 is connected with an elastic pad 2, and then is installed on a printed circuit board 10 including a light emitting unit 11. According to such a construction, whenever the light emitting unit 11 emits light, it is possible, due to the color-printed layer or cellophane paper 107, to present various colors in the keypad 100.

Figure 8:
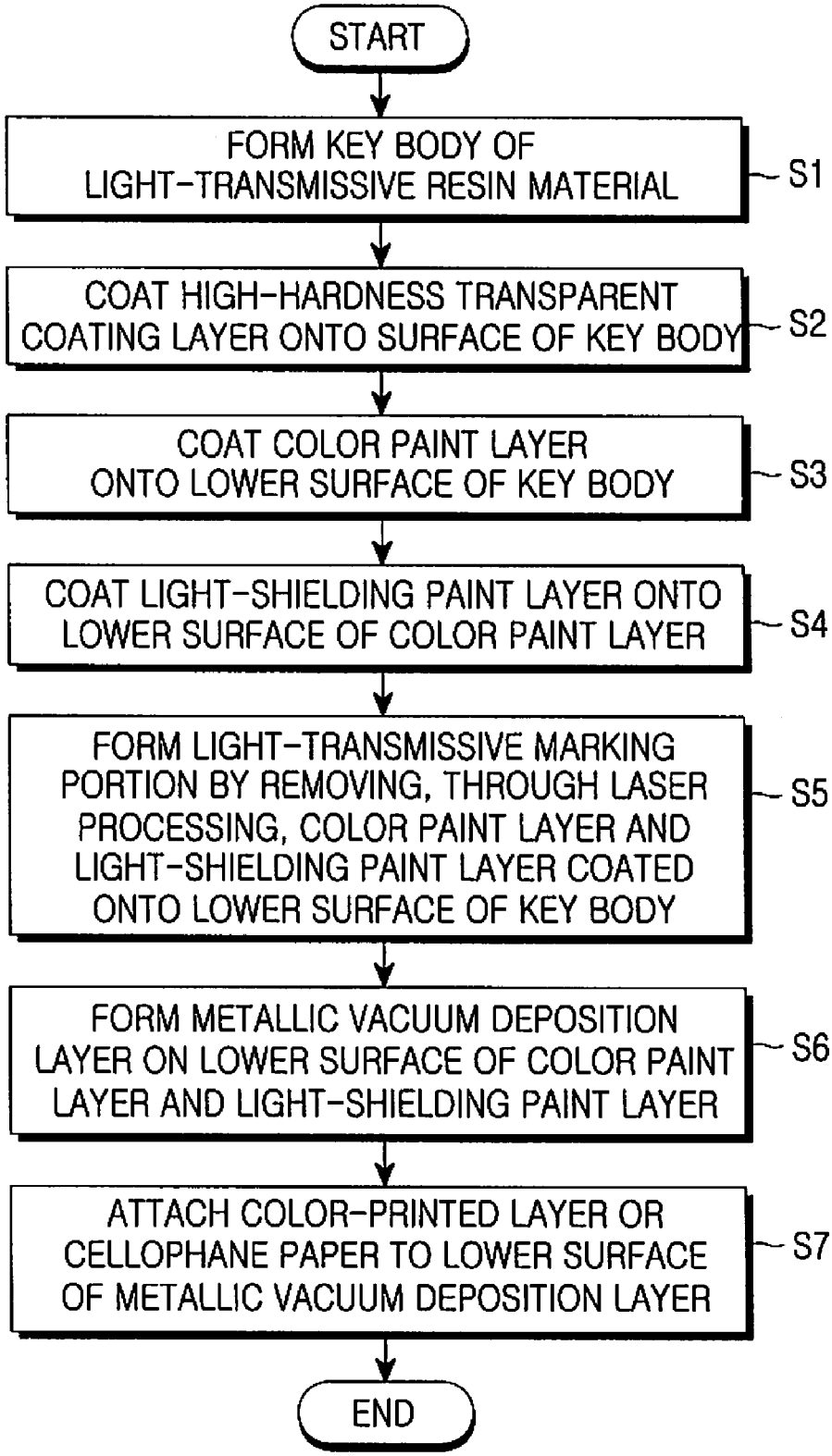
FIG. 8 is a flowchart illustrating a method for manufacturing the keypad for the mobile phone according to the present invention.

The manufacturing method of the keypad for a mobile phone, which has the above-mentioned construction according to the present invention, will be described in more detail with reference to FIGS. 4 and 8.

First, according to the manufacturing method of the keypad for a mobile phone, a key body 101 is formed of a light-transmissive resin material in step 1.

The light-transmissive resin material includes, among other materials, polycarbonate, acrylic resin, and polyethylene terephthalate (PET).

Then, a high-hardness transparent coating layer 102 is coated onto the surface of the key body 101 in order to increase hardness in step 2.

In this case, if the light-transmissive resin material includes the hardness-reinforcement and lubrication-property-reinforcement additives, the step of coating the high-hardness transparent coating layer 102 is omitted. This is because, when the key body 101 is formed of a material including the hardness-reinforcement and lubrication-property-reinforcement additives, the abrasion resistance and scratch resistance properties of the key body 101 are improved, so that it is unnecessary to coat the high-hardness transparent coating layer 102 onto the surface of the key body 101 in order to additionally improve the abrasion resistance and scratch resistance properties of the key body 101.

In step 3, a key background color paint layer 103 for color presentation is coated onto a lower surface of the key body 101.

In step 4, an opaque paint layer 104 is coated onto a lower surface of the key background color paint layer 103 in order to prevent light from being transmitted through a portion other than a light-transmissive marking portion 105.

In step 5, a laser processing according to the shape of a numeral, a character, or a symbol is performed with respect to the lower surface of the key body 101 so as to remove a part of the color paint layer 103 and the opaque paint layer 104, thereby forming the light-transmissive marking portion 105.

In step 6, a metallic vacuum deposition layer 106 is formed on a lower surface of the key body 101 and the opaque paint layer 104, which have been obtained as a result of step 5, so as to provide a metallic gloss to the keypad 100.

The metallic vacuum deposition layer 106 may be made from aluminum (Al), chromium (Cr), Nickel (Ni), tin (Sn), and titanium (Ti), and may be a compound layer which is made from silicon dioxide ($SiO_2$), titanium dioxide ($TiO_2$), or zirconium dioxide ($ZrO_2$), depending on the use purpose.

In step 7, a color-printed layer or cellophane paper 107 is attached to a lower surface of the metallic vacuum deposition layer 106, which have been obtained as a result of step 6, so that various colors can be presented whenever light is emitted from the light emitting unit 11 included in the printed circuit board 10.

The attachment of the cellophane paper 107 may be achieved by using transparent adhesives (not shown) or by a heat treatment process for applying heat.

Thereafter, the resultant key body 101 is connected with the elastic pad 2, and then is installed on the printed circuit board 10 (see FIG. 5).

While the present invention has been shown and described with reference to a certain preferred embodiment of a manufacturing method of a keypad for a mobile phone and the keypad manufactured thereby, it will be understood by those skilled in the art that various changes in form and details may be made therein without departing from the spirit and scope of the invention as defined by the appended claims.

What is claimed is:

1. A method for manufacturing a keypad which includes a plurality of keys, the method comprising the steps of:

(1) forming a key body of a light-transmissive resin material;

(2) coating a high-hardness transparent coating layer onto a surface of the key body in order to increase hardness;

(3) coating a key background color paint layer for color presentation onto a lower surface of the key body;

(4) coating a light-shielding paint layer onto a lower surface of the key background color paint layer in order to prevent light from being transmitted through a portion other than a light-transmissive marking portion;

(5) forming the light-transmissive marking portion by performing a laser processing according to a shape of a numeral, a character, or a symbol with respect to the lower surface of the key body so as to remove the key background color paint layer and the light-shielding paint layer;

(6) forming a metallic vacuum deposition layer on the lower surface of the key body and a lower surface of the light-shielding paint layer; and (7) attaching a one of color-printed layer and a cellophane paper to a lower surface of the metallic vacuum deposition layer so as to present various colors.

2. The method as claimed in claim 1, wherein step (2) is omitted by forming the key body from a high-hardness light-transmissive resin material which contains additives for reinforcing hardness and a lubrication property and thus improving abrasion resistance and scratch resistance properties of the key body.

3. The method as claimed in claim 1, wherein, in step (7), the cellophane paper is attached to a surface of an elastic pad for the keypad, or a surface of the elastic pad is color-printed.

4. The method as claimed in claim 1, wherein the light-transmissive resin material includes one of polycarbonate, acrylic resin, and polyethylene terephthalate (PET).

5. The method as claimed in claim 1, wherein the metallic vacuum deposition layer is made of any one selected from a group consisting of aluminum (Al), chromium (Cr), Nickel (Ni), tin (Sn) and titanium (Ti).

6. The method as claimed in claim 1, wherein the metallic vacuum deposition layer is made of any one selected from a group consisting of silicon dioxide ($SiO_2$), titanium dioxide ($TiO_2$), and zirconium dioxide ($ZrO_2$).

7. The method as claimed in claim 1, wherein the resin material is one of transparent and translucent.

8. The method as claimed in claim 1, wherein the light-shielding paint layer is opaque.

9. The method as claimed in claim 1, wherein the marking portion is one of transparent and translucent.

10. A keypad for a mobile phone including a plurality of keys, each key includes a key body of a light-transmissive resin material and a high-hardness transparent coating layer coated onto a surface of the key body in order to increase hardness, the key comprising:

a key background color paint layer for color presentation, coated onto a lower surface of the key body;

a light-shielding paint layer coated onto a lower surface of the key background color paint layer;

a light-transmissive marking portion formed by performing a laser processing according to a shape of a numeral, a character, or a symbol with respect to the lower surface of the key body so as to remove the key background color paint layer and the paint layer;

a metallic vacuum deposition layer formed on the lower surface of the key body and a lower surface of the paint layer; and a color-printed layer or a cellophane paper attached to a lower surface of the metallic vacuum deposition layer so as to present various colors.

11. The keypad as claimed in claim 10, wherein the resin material includes a high-hardness resin material which contains additives for reinforcing hardness and a lubrication property so as to improve abrasion resistance and scratch resistance properties of the key body.

12. The keypad as claimed in claim 10, wherein the resin material includes one of polycarbonate, acrylic resin, and polyethylene terephthalate (PET).

13. The keypad as claimed in claim 10, wherein the metallic vacuum deposition layer is made of any one selected from a group consisting of aluminum (Al), chromium (Cr), Nickel (Ni), tin (Sn), and titanium (Ti).

14. The keypad as claimed in claim 10, wherein the metallic vacuum deposition layer is made of any one selected from a group consisting of silicon dioxide ($SiO_2$), titanium dioxide ($TiO_2$), and zirconium dioxide ($ZrO_2$).

15. The method as claimed in claim 10, wherein the resin material is one of transparent and translucent.

16. The Method as claimed in claim 10, wherein the paint layer is opaque.

17. The method as claimed in claim 10, wherein the marking portion is one of transparent and translucent.

18. A keypad for a mobile phone including a plurality of keys, each key comprising:

a key body made of a transparent resin material;

a high-hardness transparent coating layer coated onto a surface of the key body in order to increase hardness;

a key background color paint layer for color presentation, coated onto the key body;

an opaque paint layer coated onto the key background color paint layer;

a transparent marking portion formed by performing a laser processing according to a shape of a numeral, a character, or a symbol with respect to the key body so as to remove the key background color paint layer and the opaque paint layer;

a metallic vacuum deposition layer formed on the opaque paint layer and the transparent marking portion; and a color-printed layer or a cellophane paper attached to the metallic vacuum deposition layer so as to present various colors.

* * * * *